US005921483A

United States Patent [19]

Fölling et al.

[11] Patent Number: 5,921,483

[45] Date of Patent: Jul. 13, 1999

[54] IMPACT ASSEMBLY FOR IMPACT CRUSHER

[75] Inventors: Klaus Fölling, Ennigerloh; Werner Krokor, Beckum, both of Germany

[73] Assignee: Krupp Fordertechnik GmbH, Essen, Germany

[21] Appl. No.: 09/007,713

[22] Filed: Jan. 15, 1998

[30] Foreign Application Priority Data

Jan. 31, 1997 [DE] Germany ..... 297 01 622 U

[51] Int. Cl.[6] ..... B02C 13/09

[52] U.S. Cl. ..... 241/189.1; 241/286

[58] Field of Search ..... 241/189.1, 189.2, 241/286, 290

[56] References Cited

U.S. PATENT DOCUMENTS

| | | | |
|---|---|---|---|
| 1,044,441 | 11/1912 | Buchanan | 241/189.1 |
| 1,125,137 | 1/1915 | Liggett | 241/286 |
| 1,274,126 | 7/1918 | Williams | 241/286 |
| 1,742,511 | 1/1930 | Kuntz | 241/286 |
| 5,713,527 | 2/1998 | Hemesath et al. | 241/189.1 |

FOREIGN PATENT DOCUMENTS

| | | | |
|---|---|---|---|
| 1 166 593 | 9/1960 | Germany . | |
| 4128373 | 3/1993 | Germany | 241/189.1 |
| 93 20 730 | 2/1995 | Germany . | |
| 94 13 571 | 5/1995 | Germany . | |
| 40 40 076 | 4/1996 | Germany . | |
| 332 712 | 10/1997 | Germany . | |

*Primary Examiner*—Mark Rosenbaum
*Attorney, Agent, or Firm*—Herbert Dubno

[57] ABSTRACT

In order to design the positional displacement of the impact member structurally simple and operationally reliable in an impact crusher having a rotor 9 and an impact member provided in the housing in an adjustable position directly underneath the feed aperture of the material to be crushed, the impact member is provided with an impact plate linearly displaceable in relation to the rotor.

9 Claims, 4 Drawing Sheets

IMPACT ASSEMBLY FOR IMPACT CRUSHER

FIELD OF THE INVENTION

The present invention relates to an impact member and a mounting assembly for an impact crusher having a rotor and an impact member provided in a crusher housing so that the position of the impact member can be adjusted directly underneath the feed aperture for the material to be crushed.

BACKGROUND OF THE INVENTION

An impact crusher is known from DE 44 40 076 C1 and has an impact member provided directly underneath the entry to the housing and pivotal around a horizontal axis. Such impact members are structurally complex and prone to faulty operation.

OBJECT OF THE INVENTION

It is the principal object of the invention to provide an impact member and a mounting assembly for an impact crusher which are of simple design and operationally reliable.

SUMMARY OF THE INVENTION

This object is achieved with an impact member which has an impact plate linearly displaceable in relation to the rotor.

It is an important feature of the invention that the impact member directly underneath the entry to the housing, is mounted so as to be linearly displaceable in relation to the rotor via drive mechanisms, for example hydraulic cylinders, the requisite gap width of the crushing gap being ensured by the provision of a predetermined number of spacer discs or shims on support plates or flanges.

A further important feature of the present invention resides in that the impact plate, brought into its working position by means of spacer discs or shims, is firmly pressed onto the support flanges by hydraulic pressure cylinders. This ensures that the function of the impact member is ensured in all circumstances and that no damaging foreign-object material can enter between these two parts, thereby ensuring a troublefree displacement of the impact plates.

Each one of the variable number of pressure cylinders projecting into the crushing chamber, is further protected against damage and dust by a protective cap.

This linearly displaceable impact plate according to the invention for impact crushers is characterized, in particular, by a low production cost. In addition, it is easy to employ. Also, it allows short retooling periods and ensures a trouble-free crushing operation.

According to the invention, therefore, the impact member in an impact crusher can comprise an impact plate mounted in said housing directly below said intake aperture and above said rotor; and means for mounting said impact plate for linear movement thereof relative to said rotor to adjust a crushing gap of the impact crusher.

According to a feature of the invention, the mounting means includes a pair of horizontally spaced lateral support flanges formed on said housing and supporting opposite horizontally spaced edges of said impact plate, and a pair of hydraulic adjusting cylinders operatively connected to said impact plate at said opposite edges for linearly displacing said impact plate along said lateral support flanges.

The mounting means can include a support plate at a lower side of said impact plate at each of said support flanges, and a respective variable number of spacers received between each of said support plates and said lower side of said impact plate.

Each of the spacers can be provided with a handle enabling insertion of said spacers and removal of said spacers between the respective support plate and said lower side of said impact plate.

The mounting means can include a plurality of hydraulic pressing cylinders actuatable for pressing said impact plate against said support flanges.

Since the hydraulic pressing cylinders are exposed in the crushing chamber, it has been found to be advantageous to provide a protective cap on each of the hydraulic pressing cylinders.

The invention also comprises an impact crusher having a housing, a rotor and at least one impact member with a breaker plate and mounting means as described. A plurality of breaker members can also be provided in angularly spaced relationship about the orbit of the rotor, and, while all or some of the breaker plates can be linearly displaceable as has been described, at least one impact member is provided directly below the intake opening and that impact member is provided, according to the invention, with the linearly shiftable impact plate.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
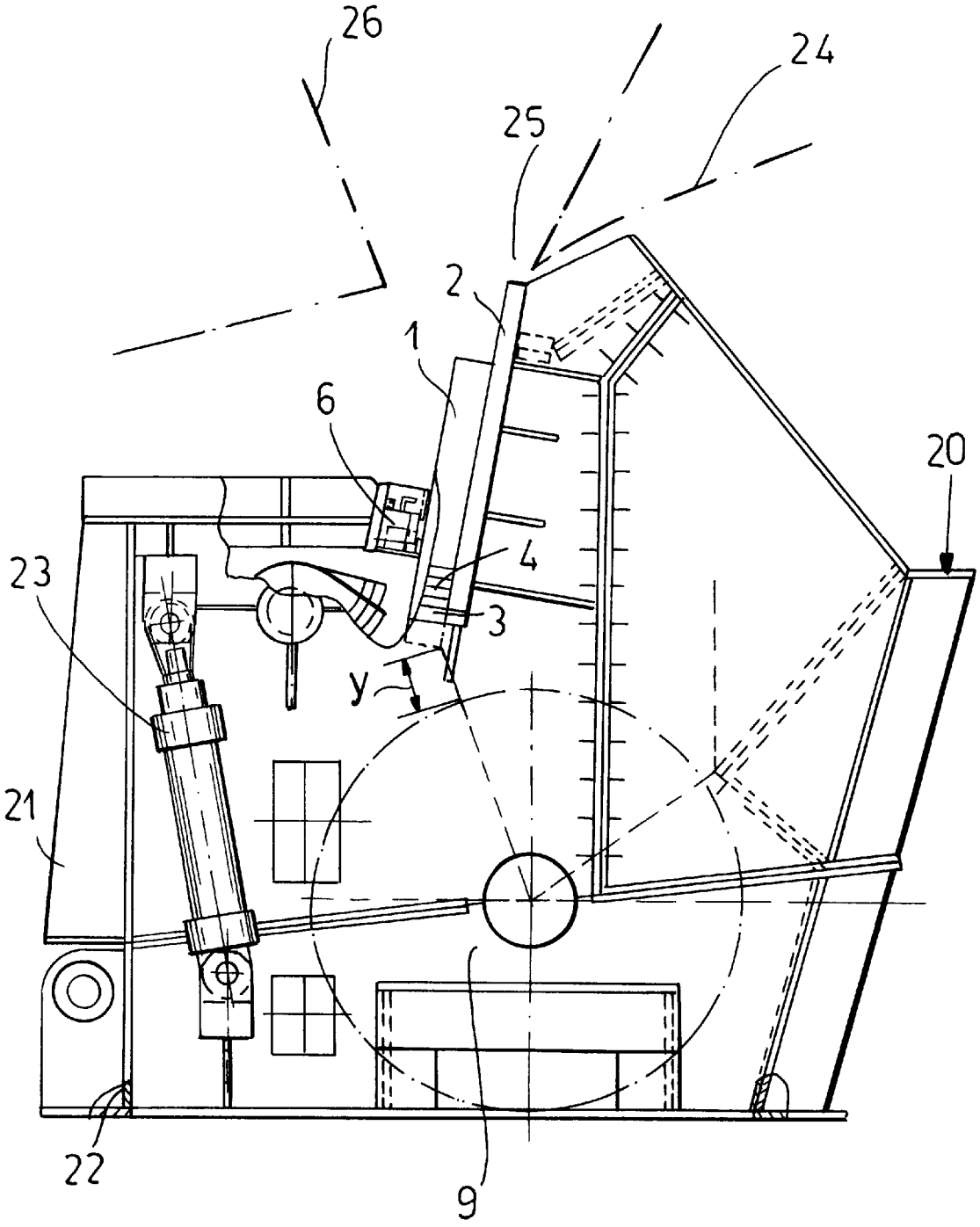
FIG. 1 is a diagrammatic cross-section of the impact crusher including the impact plate arrangement.

The impact crusher shown in FIG. 1 comprises a rotor 9 adapted to be rotationally-driven, mounted in a housing and usually equipped with crushing elements not shown in the drawing, such as hangers. The rotor 9 may, more particularly, be provided with hammers or impact bars as described in the Chemical Engineers' Handbook Perry and Chilton, 5th Edition, McGraw Hill Book Company, NY, 1973, Chapter 8, pages 22 ff or the German Patent Document 44 40 076 mentioned previously.

Other impact breakers having impact members for which the impact member of the invention can be substituted, can be found in German Patent Documents 11 66 593, 94 13 571.1 and 93 20 730.1, and Austrian Patent Document 332 712. In general, the housing 20 (FIG. 1) can include upper and lower housing parts 21 and 22 which can be swung relatively to one another by a hydraulic cylinder arrangement 23 to afford access to the impact member 1,2, etc.

The outer shell of the housing is represented by the dot dash line 24 and the intake opening or aperture 25 has been shown in FIG. 1 as well. The housing can have a feed chute 26 communicating with the intake aperture 25. The first impact member is provided on support flanges 2 above the rotor 9, directly underneath the entry to the housing. The impact member comprises the impact plate 1 which is linearly displaceable in relation to the rotor 9, forming a crushing gap with a stepwise adjustable gap width y for crushing large sized components of the material to be crushed. In FIG. 1 the crusher plate 1 is illustrated in the clamped position, i.e. with spacer shims or discs 4 provided on a support plate 3 and with hydraulic pressure cylinders 6 in working position.

Figure 3:
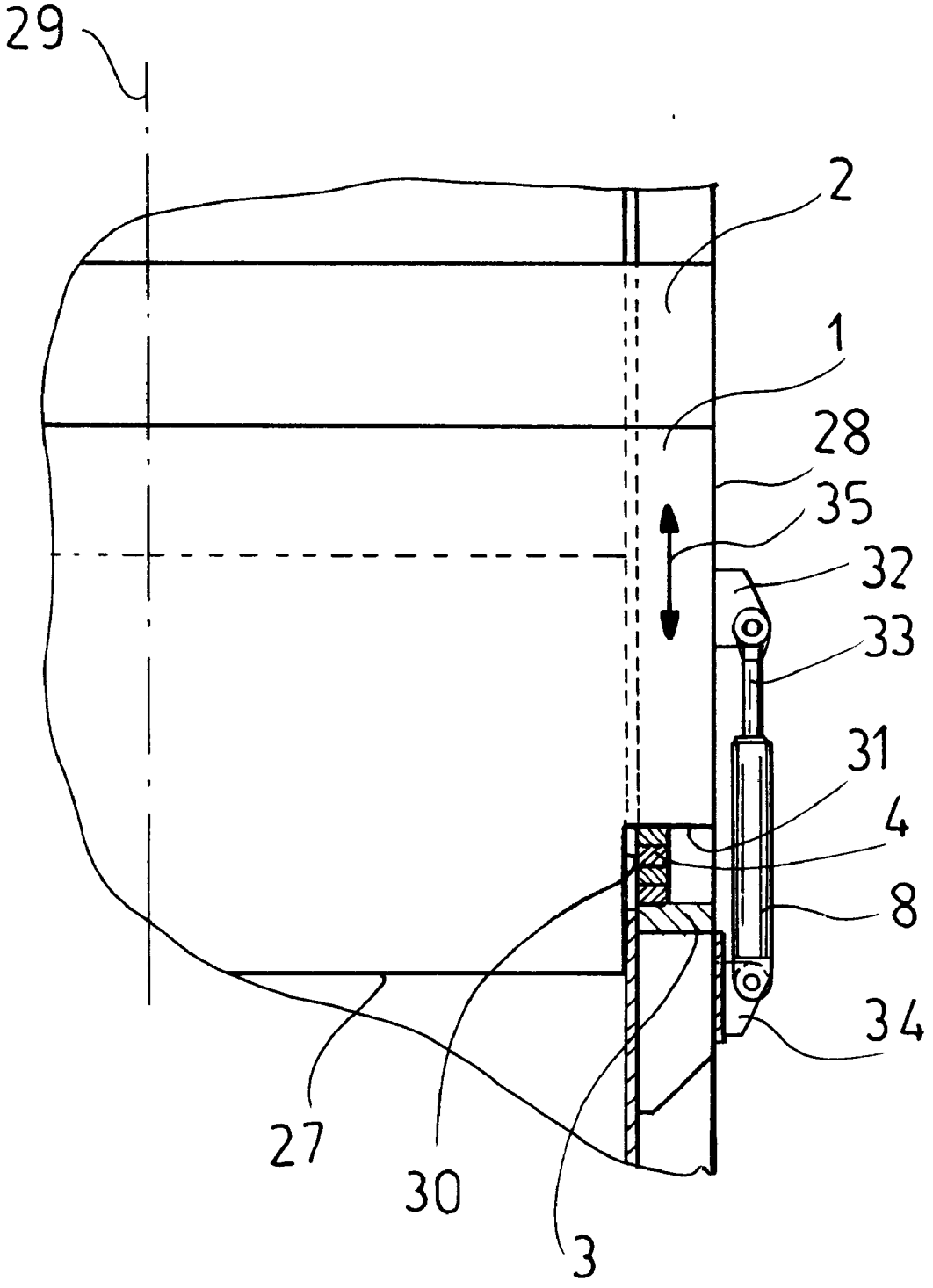
FIG. 3 is a section taken along the line III—III of FIG. 2 across the impact plate-support flange arrangement.

The support flanges 2 are shown to be mounted on the structure 21 of the housing along the opposite edges of the impact plate 1 which, as can be seen from FIG. 3, has a bottom edge 27 and two lateral edges 28, only one of which is seen in FIG. 3 but which correspond to a similar edge on the opposite side of the plate which is symmetrical with respect to a center symmetry plane 29 of the crusher.

The edge 28 is provided with a step 30 forming an underside 31 which rests upon the stack of shins or spacers 4. The edge 28 can be provided with a lug 32 to which the piston 33 of cylinder 8 is pivotally connected.

The cylinder 8 is pivotally connected in turn, to a lug 34 affixed to the support 2 and the cylinder 8 can be parallel to the support for the linear displacement of the plate 1 along the support in the direction represented by the double headed arrow 35, i.e. parallel to the plane of the plate.

The hydraulic pressure cylinders 6 (see FIGS. 2 and 4) can be braced against plates 36 forming part of the structure 21 previously described. The axes of the cylinders 6 are perpendicular to the plane of the impact plate 1 so that, when the cylinders 6 spaced apart across the plate 1 are hydraulically actuated, the plate 1 can be clamped against the support flanges 2.

Figure 2:
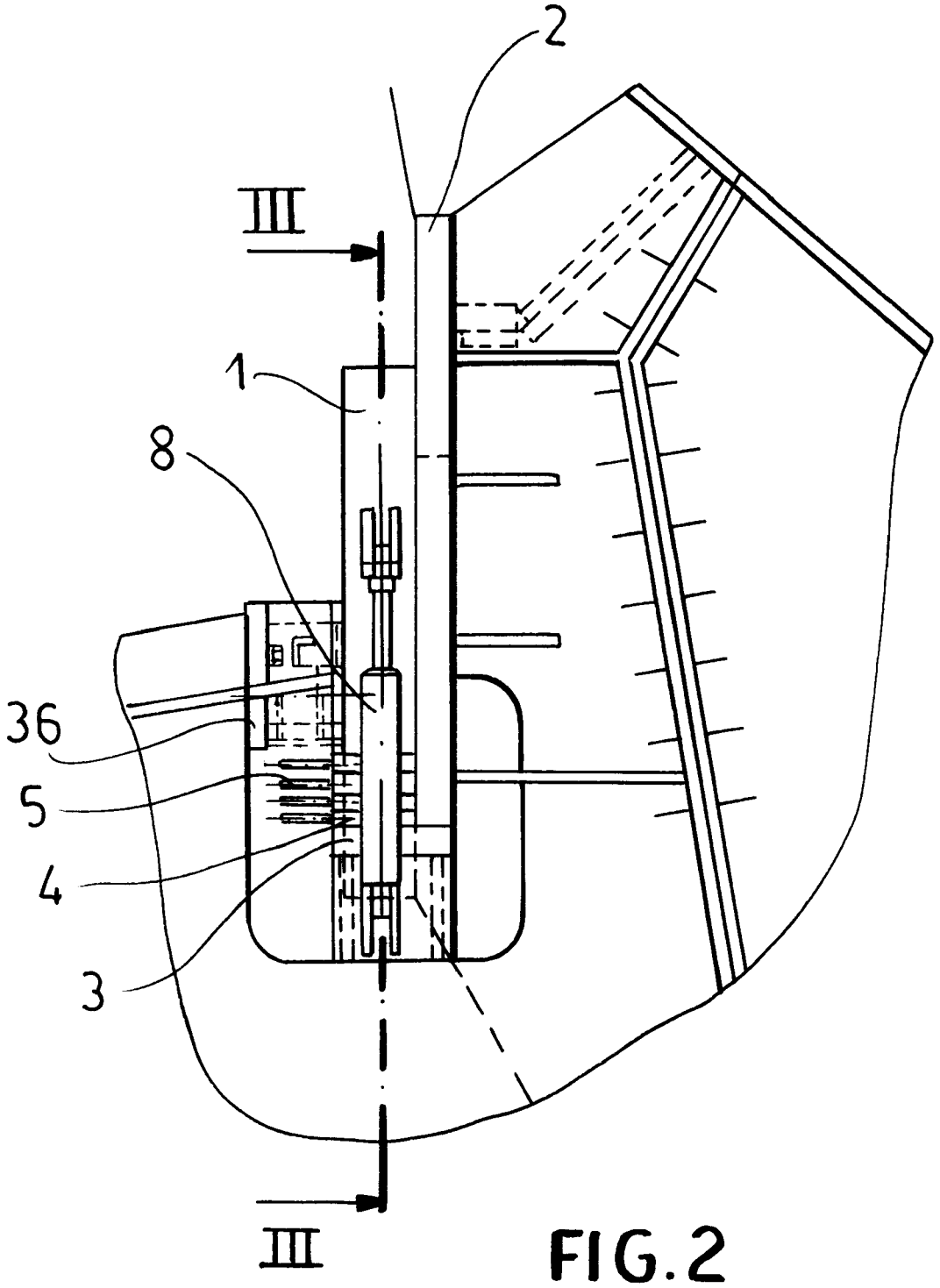
FIG. 2 is a section on a larger scale of the hydraulically activatable impact plate support flange spacer disc arrangement according to FIG. 1.

FIGS. 2 and 3 in different views illustrate the impact plate 1 resting on the support flange 2 according to FIG. 1 including the hydraulic cylinders 8 bringing about the linear displacement in relation to the rotor 9, not shown here, and including spacer shims or discs 4 with handles 5 mounted on support plates 3. The clamping position is brought about by the associated hydraulic pressure cylinders 6. The fixation of the hydraulic cylinders 8 to the housing and the impact plate 1 is also apparent from FIG. 3.

The handles 5 enable, with the cylinders 8 extended and the clamping force of hydraulic cylinders 6 relieved, one or more spacers 4 to be inserted between the support plates 3 and the underside of the impact plate 1 to adjust the gap Y and the size of the material produced between the rotor 9 and the impact plate 1. After the requisite number of spacers has been introduced or the number of spacers has been reduced to the desired number, the cylinders 8 can be actuated to draw the impact plate 1 down against the respective stacks of spacers, whereupon the cylinders 6 are actuated to clamp the impact plate 1 to the support flanges 2.

Figure 4:
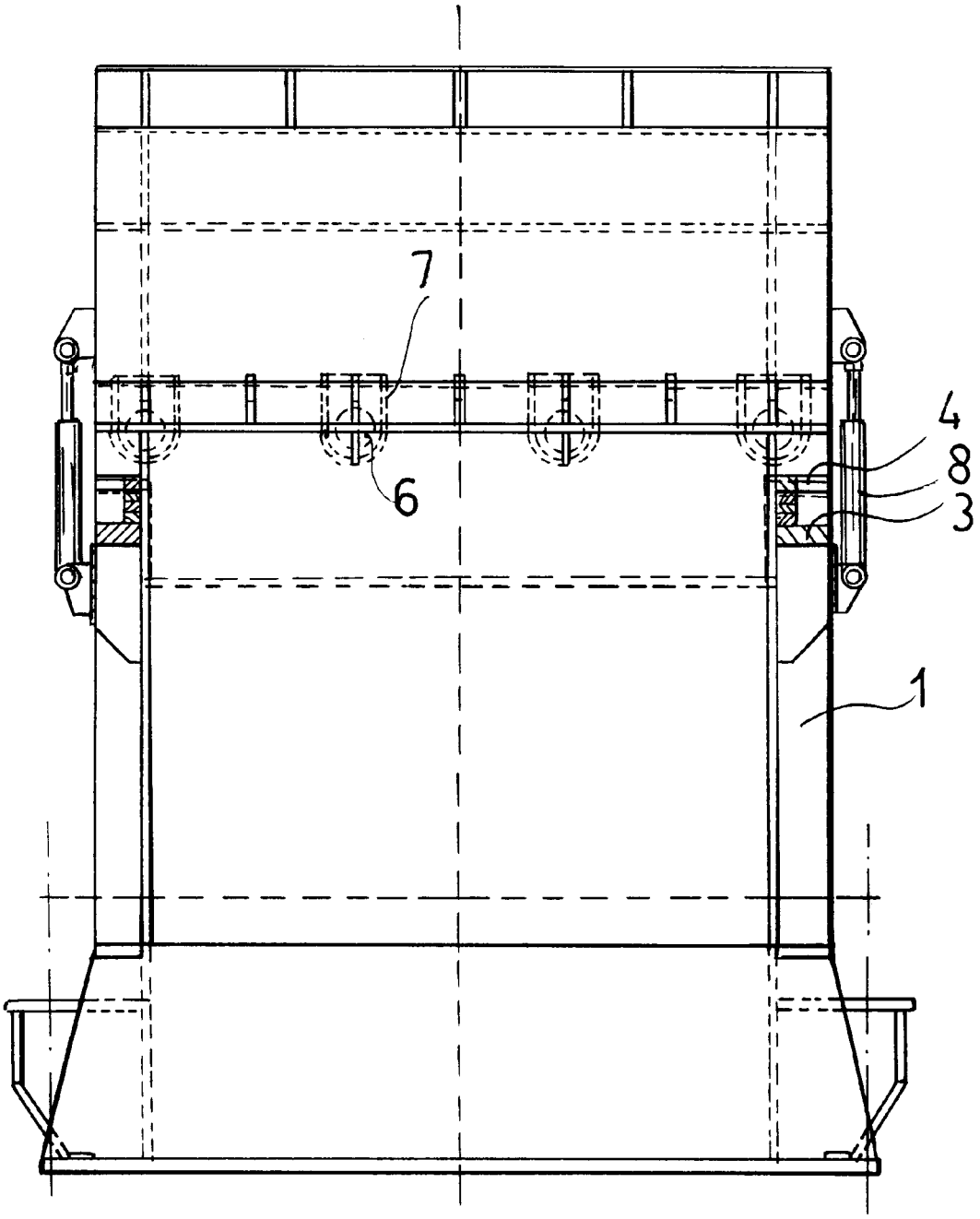
FIG. 4 is an elevational view of an impact crusher housing comprising an impact plate drive mechanism and a spacer disc arrangement, partly broken away.

FIG. 4 schematically shows the example of an arrangement of the hydraulic pressure cylinders 6 and the hydraulic cylinder 8 on the housing and the impact assembly comprising the arrangement of the support plate 3 and the spacer shims or discs 4. From this FIG. 4 it is furthermore apparent that each of the hydraulic pressure cylinders 6 projecting into the crushing chamber of the impact crusher has a respective protective cap 7 protecting the pressure cylinders 6 against damage and dust.

The incremental linear displacement of the impact plate 1 in relation to the rotor 9, forming a stepwise adjustable crushing gap, takes place by releasing the hydraulic cylinders 8 with subsequent fitting or removing of spacers 4 by means of their respective handles 5 and by subsequent lowering of the impact plate 1 as well as damping of the latter by means of the hydraulic pressure cylinders 6.

We claim:

1. An impact crusher comprising:

a crusher housing formed with an intake aperture for receiving material to be crushed;

a crusher rotor rotatable beneath said intake aperture in said crusher housing;

an impact plate mounted in said housing directly below said intake aperture and above said rotor, said plate lying in a plane and having a lower edge juxtaposed with said rotor and defining a crushing gap of the impact crusher with said rotor; and means for mounting said impact plate for linear movement thereof in said plane toward and away from said rotor to adjust said crushing gap of the impact crusher, said mounting means including a pair of horizontally spaced lateral support flanges formed on said housing and supporting opposite horizontally spaced edges of said impact plate, said support flanges having surfaces guiding said plate for movement in said plane, and a pair of hydraulic adjusting cylinders operatively connected to said impact plate at said opposite edges for linearly displacing said impact plate along said surface of said lateral support flanges.

2. The impact crusher defined in claim 1 wherein said mounting means includes a support plate at a lower side of said impact plate at each of said support flanges, and a respective variable number of spacers received between each of said support plates and said lower side of said impact plate.

3. The impact crusher defined in claim 2 wherein each of said spacers is provided with a handle enabling insertion of said spacers and removal of said spacers between the respective support plate and said lower side of said impact plate.

4. The impact crusher defined in claim 3 wherein said mounting means includes a plurality of hydraulic pressing cylinders actuatable for pressing said impact plate against said support flanges.

5. The impact crusher defined in claim 4, further comprising a protective cap on each of said hydraulic pressing cylinders.

6. An impact crusher comprising:

a crusher housing formed with an intake aperture for receiving material to be crushed;

a crusher rotor rotatable beneath said intake aperture in said crusher housing;

an impact plate mounted in said housing directly below said intake aperture and above said rotor, said plate lying in a plane and having a lower edge juxtaposed with said rotor and defining a crushing gap of the impact crusher with said rotor; and means for mounting said impact plate for linear movement thereof in said plane toward and away from said rotor to adjust said crushing gap of the impact crusher, said mounting means including a pair of horizontally-spaced lateral support flanges formed on said housing, and a support plate at a lower side of said impact plate at each of said support flanges, and a respective variable number of spacers received between each of said support plates and said lower side of said impact plate.

7. The impact crusher defined in claim 6 wherein each of said spacers is provided with a handle enabling insertion of said spacers and removal of said spacers between the respective support plate and said lower side of said impact plate.

8. An impact crusher comprising:

a crusher housing formed with an intake aperture for receiving material to be crushed;

a crusher rotor rotatable beneath said intake aperture in said crusher housing;

an impact plate mounted in said housing directly below said intake aperture and above said rotor, said plate lying in a plane and having a lower edge juxtaposed with said rotor and defining a crushing gap of the impact crusher with said rotor; and means for mounting said impact plate for linear movement thereof in said plane toward and away from said rotor to adjust said crushing gap of the impact crusher, said mounting means including a pair of horizontally-spaced lateral support flanges on said housing, and a plurality of hydraulic pressing cylinders actuatable for pressing said impact plate against surfaces of said support flanges.

9. The impact crusher defined in claim 8, further comprising a protective cap on each of said hydraulic pressing cylinders.

* * * * *